US010054879B2

(12) United States Patent
Takahashi et al.

(10) Patent No.: US 10,054,879 B2
(45) Date of Patent: Aug. 21, 2018

(54) IMAGE FORMING APPARATUS

(71) Applicant: FUJI XEROX CO., LTD., Tokyo (JP)

(72) Inventors: Yoshinori Takahashi, Kanagawa (JP); Masahiro Katahira, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/613,775

(22) Filed: Jun. 5, 2017

(65) Prior Publication Data

US 2018/0136592 A1 May 17, 2018

(30) Foreign Application Priority Data

Nov. 15, 2016 (JP) ..... 2016-221981

(51) Int. Cl.
*G03G 15/20* (2006.01)
*G03G 15/16* (2006.01)

(52) U.S. Cl.
CPC ..... *G03G 15/1615* (2013.01); *G03G 15/168* (2013.01)

(58) Field of Classification Search
CPC ..... G03G 15/168; G03G 15/1615
See application file for complete search history.

(56) References Cited

U.S. PATENT DOCUMENTS

2007/0258737 A1* 11/2007 Ogiyama ..... G03G 15/1675 399/315
2012/0269529 A1* 10/2012 Heid ..... G03G 15/1675 399/66

FOREIGN PATENT DOCUMENTS

JP 2005-266612 A 9/2005

* cited by examiner

*Primary Examiner* — David M Gray
*Assistant Examiner* — Michael Harrison
(74) *Attorney, Agent, or Firm* — Sughrue Mion, PLLC

(57) ABSTRACT

An image forming apparatus includes a transfer unit and a static eliminating unit. The transfer unit transfers a toner image formed on an image holding body to a recording medium. The static eliminating unit is disposed downstream of the transfer unit in a transport direction in which the recording medium is transported, stores electric charge while the recording medium is passing through a recording medium transfer region, and releases the electric charge when a leading edge of the recording medium enters the recording medium transfer region.

20 Claims, 13 Drawing Sheets

IMAGE FORMING APPARATUS

CROSS-REFERENCE TO RELATED APPLICATIONS

This application is based on and claims priority under 35 USC 119 from Japanese Patent Application No. 2016-221981 filed Nov. 15, 2016.

BACKGROUND

Technical Field

The present invention relates to an image forming apparatus.

SUMMARY

According to an aspect of the present invention, an image forming apparatus includes a transfer unit and a static eliminating unit. The transfer unit transfers a toner image formed on an image holding body to a recording medium. The static eliminating unit is disposed downstream of the transfer unit in a transport direction in which the recording medium is transported, stores electric charge while the recording medium is passing through a recording medium transfer region, and releases the electric charge when a leading edge of the recording medium enters the recording medium transfer region.

BRIEF DESCRIPTION OF THE DRAWINGS

Exemplary embodiment of the present invention will be described in detail based on the following figures, wherein.

DETAILED DESCRIPTION

Figure 1:
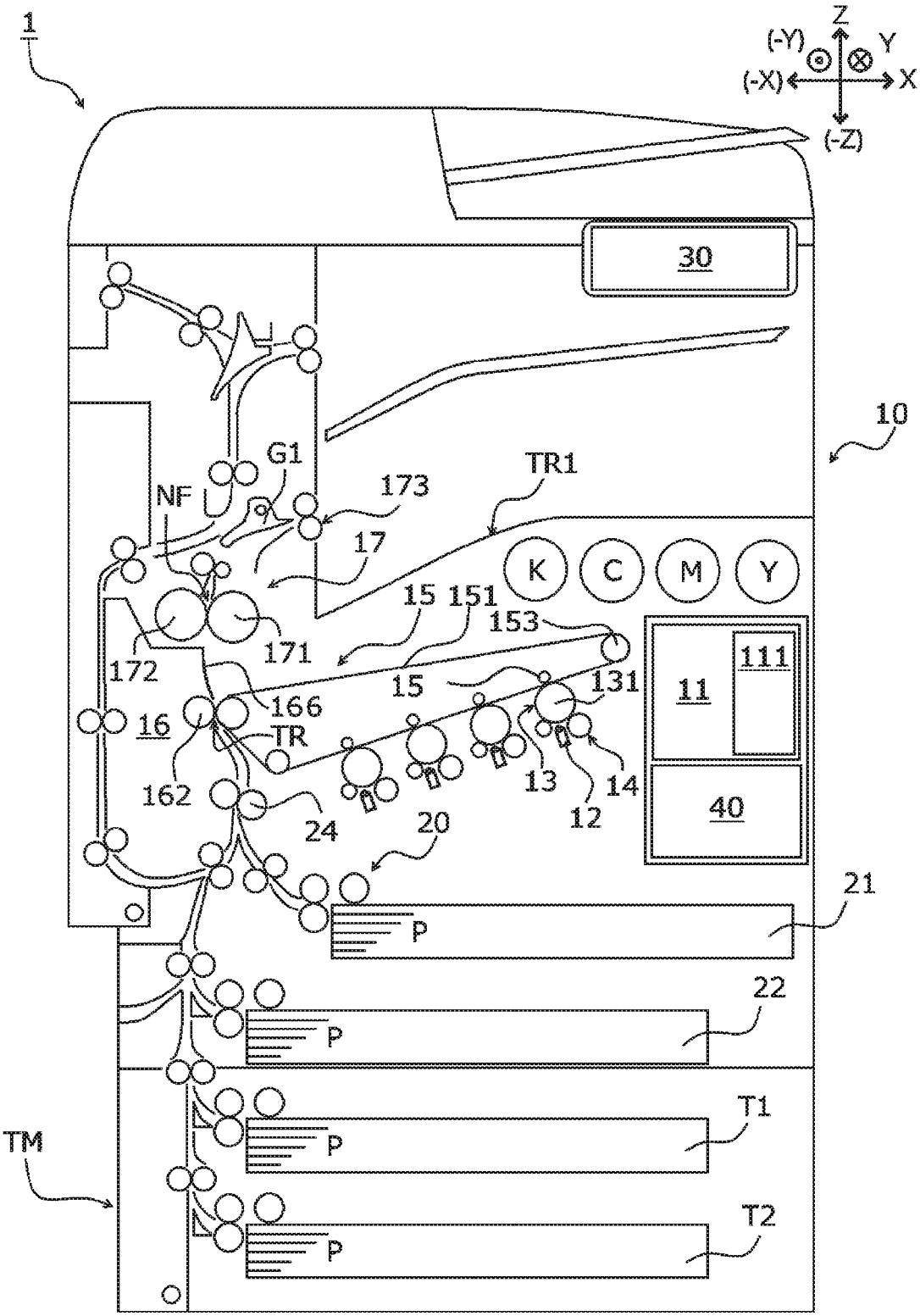
FIG. 1 is a schematic sectional view of an internal structure of an image forming apparatus.

Next, an exemplary embodiment and specific examples of the present invention will be described in further detail below with reference to the drawing. However, it should be understood that the present invention is not limited to the exemplary embodiment and the specific examples.

Furthermore, it should be noted that the drawings referred to in the following description are schematically illustrated and, for example, ratios between the dimensions of elements are different from actual ratios, and illustration of elements not required for the description is omitted as appropriate for ease of understanding.

Also for ease of understanding in the following description, the front-rear direction is represented as the X direction, the left-right direction is represented as the Y direction, and the up-down direction is represented as the Z direction in the drawings.

(1) An Overall Structure and Operation of an Image Forming Apparatus

FIG. 1 is a schematic sectional view of an internal structure of an image forming apparatus 1 according to a first exemplary embodiment.

An overall structure and operation of the image forming apparatus 1 are described below with reference to the drawings.

(1.1) The Overall Structure of the Image Forming Apparatus

The image forming apparatus 1 includes an image forming section 10, a sheet feed device 20 attached at a bottom portion of the image forming section 10, an operating display 30, and an image processing unit 40.

The image forming section 10 includes a system controller 11, light exposure devices 12, photosensitive units 13, developing devices 14, a transfer device 15, a sheet transport device 16, and a fixing device 17. The image forming section 10 receives image information from the image processing unit 40 and forms toner images of the image information on sheets of paper P fed from the sheet feed device 20.

The sheet feed device 20 that includes sheet trays 21 and 22 is provided at the bottom portion of the image forming section 10 so as to feed the sheets P to the image forming section 10. Furthermore, a tray module TM is connected to a lower portion of the sheet feed device 20 so as to feed the sheets P to the image forming section 10. The tray module TM includes sheet trays T1 and T2 that are vertically stacked to form a multi-tray structure (two trays according to the present exemplary embodiment) and that contain the sheets P.

That is, plural trays that contain different types (for example, material, thickness, sheet size, and paper grain) of the sheets P are provided, and each of the sheets P fed from one of these plural trays is supplied to the image forming section 10.

The operating display 30 corresponds to a so-called user interface. Specifically, the operating display 30 includes a liquid crystal display panel, various operating buttons, a touch panel, and so forth combined with one another, so that the operating display 30 is used to input various settings and instructions and display information.

Figure 2:
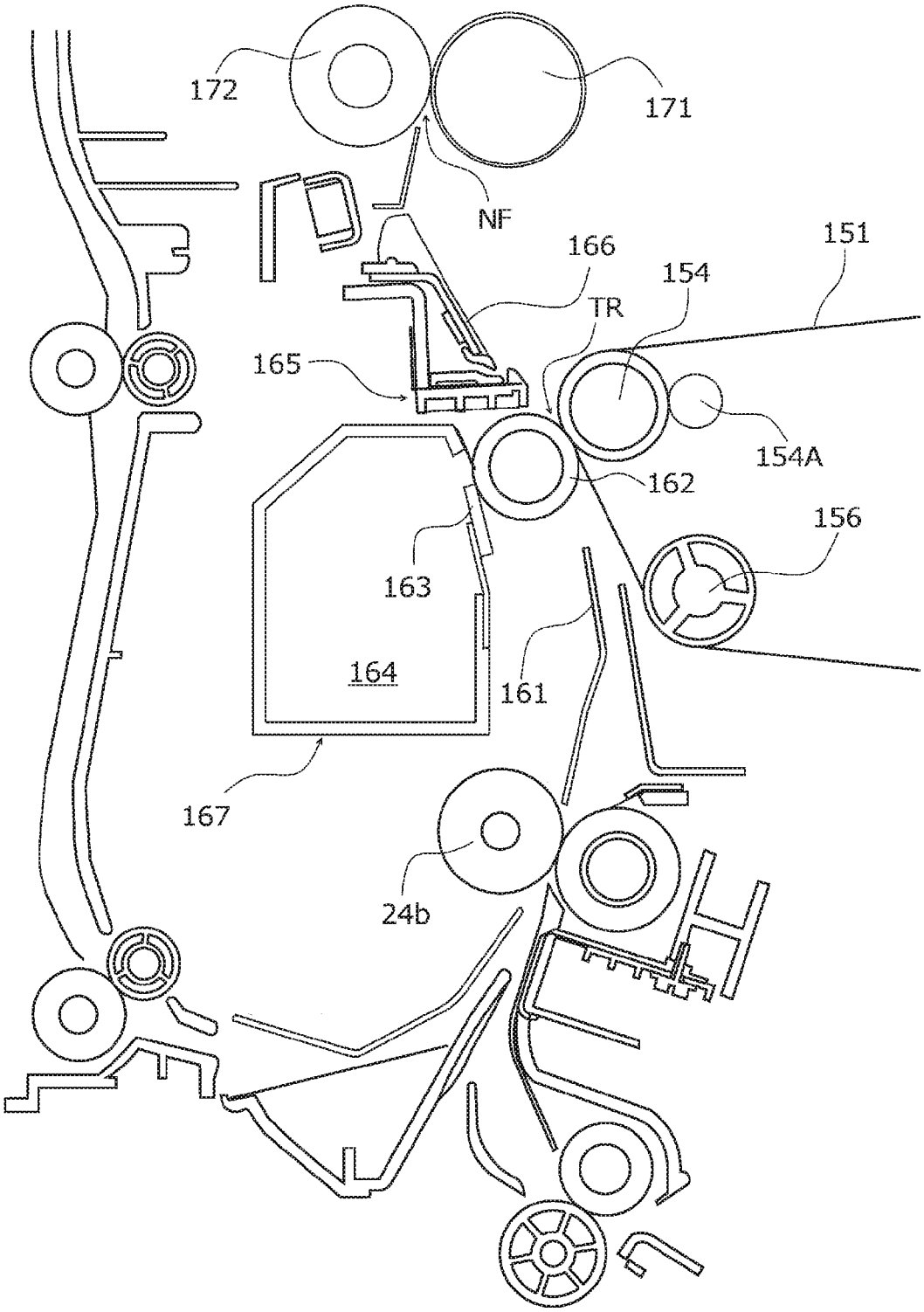
FIG. 2 is a schematic sectional view of a sheet transport device having a second transfer portion.

The image processing unit 40 generates image data from print information transmitted from an external device 82 (illustrated in FIG. 2, for example, personal computer or the like).

(1.2) A Structure and Operation of the Image Forming Section

In the image forming apparatus 1 having such a structure, the sheets P are fed from the trays of the sheet feed device 20 or the tray module TM to the image forming section 10 at timing adjusted to timing of image formation. The trays of these sheets P are specified by print jobs on a sheet-by-sheet basis for printing.

The photosensitive units 13 are arranged in parallel to one another above (Z direction) the sheet feed device 20. The photosensitive units 13 include respective photosensitive drums 131 that are rotated. Electrostatic latent images are formed on the photosensitive drums 131 by the respective light exposure devices 12. Toner image components of yellow (Y), magenta (M), cyan (C), and black (K) are formed by the respective developing devices 14 on the photosensitive drums 131 bearing these electrostatic latent images.

The transfer device 15 includes an intermediate transfer belt 151 serving as an image holding body and first transfer rollers 152. The toner image components of the colors formed on the photosensitive drums 131 of the photosensitive units 13 are transferred onto the intermediate transfer belt 151 so as to be superposed on one another. The first transfer rollers 152 sequentially transfer (first transfer) the toner image components of the colors formed by the photosensitive units 13 onto the intermediate transfer belt 151.

The sheet transport device 16 includes a driven roller 24*b* of a registration roller pair 24 and a second transfer roller 162. The driven roller 24*b* corrects the orientation of each of the sheets P fed from the sheet feed device 20 and feeds the sheet P to a second transfer portion TR at timing adjusted to timing of second transfer. The second transfer roller 162 collectively transfers (second transfer) onto the sheet P serving as a recording medium the toner image components of the colors having been transferred onto the intermediate transfer belt 151 so as to be superposed on one another. Furthermore, the sheet P onto which the transferred toner image components are held is guided to a fixing nip NF of the fixing device 17 through a transport guide 166.

The toner image components of the colors formed on the photosensitive drums 131 of the respective photosensitive units 13 are sequentially electrostatically transferred (first transfer) onto the intermediate transfer belt 151 by the first transfer rollers 152 to each of which a specified transfer voltage is applied from a power source unit controlled by the system controller 11. Thus, a toner image that is a superposed toner image in which the toner image components of the colors are superposed on one another is formed.

The superposed toner image on the intermediate transfer belt 151 is transported to the second transfer portion TR as the intermediate transfer belt 151 is moved. When the superposed toner image is transported to the second transfer portion TR, the sheet P is supplied from the registration roller pair 24 to the second transfer portion TR at timing adjusted to timing at which the superposed toner image is transported the second transfer portion TR.

A specified transfer voltage is applied to the second transfer roller 162 by the power source unit controlled by the system controller 11. Thus, the superposed toner image on the intermediate transfer belt 151 is collectively transferred onto the sheet P fed from the registration roller pair 24.

The fixing device 17 includes a heating module 171 and a pressure module 172, which are in pressure contact with each other in a pressure contact region so as to define a fixing nip NF (fixing region). The sheet P onto which the toner image has been collectively transferred in the second transfer portion TR is transported to the fixing device 17 through the transport guide 166 while the toner image is still unfixed. The toner image on the sheet P transported to the fixing device 17 is fixed by actions of pressure and heat applied thereto by a pair of the heating module 171 and the pressure module 172.

The sheet P on which a fixed toner image has been formed is guided to a switching gate G1 so as to be output to, by a first output roller pair 173, and received in a sheet output tray TR1 provided in an upper surface of the image forming apparatus 1. Furthermore, in order to invert the sheet P for duplex printing or output the sheet P with an image recording side facing upward, a transport direction of the sheet P is changed toward the transport guide 166 by the switching gate G1.

(2) A Functional Configuration and Operation of the Image Forming Apparatus 1

Figure 3A:
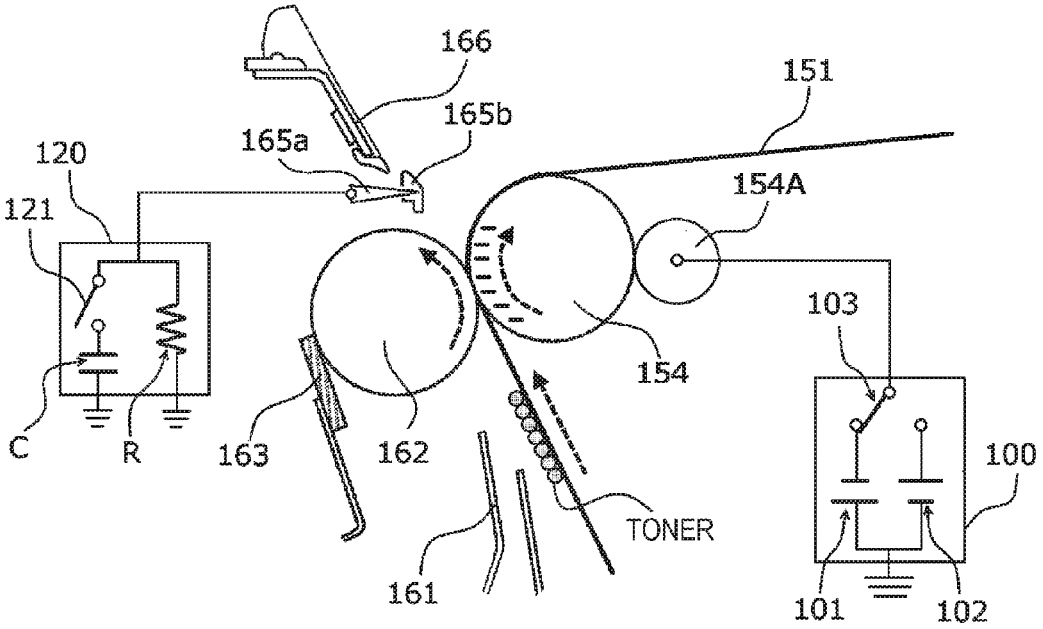
FIGS. 3A and 3B illustrate a configuration of the second transfer portion and a region around the second transfer portion and application of a bias for second transfer.
Figure 3B:
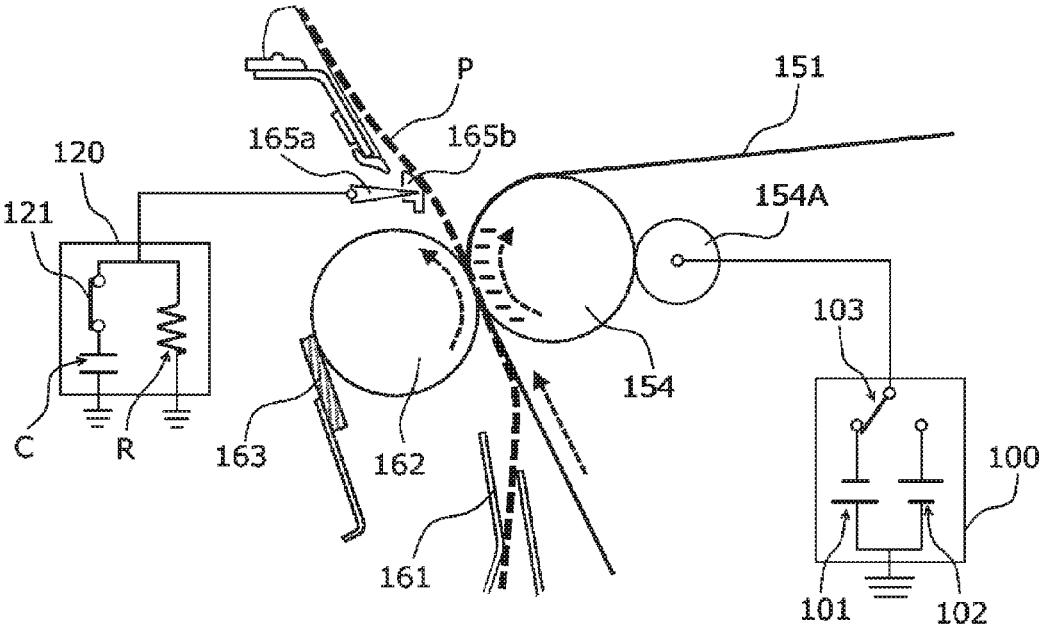
Figure 4:
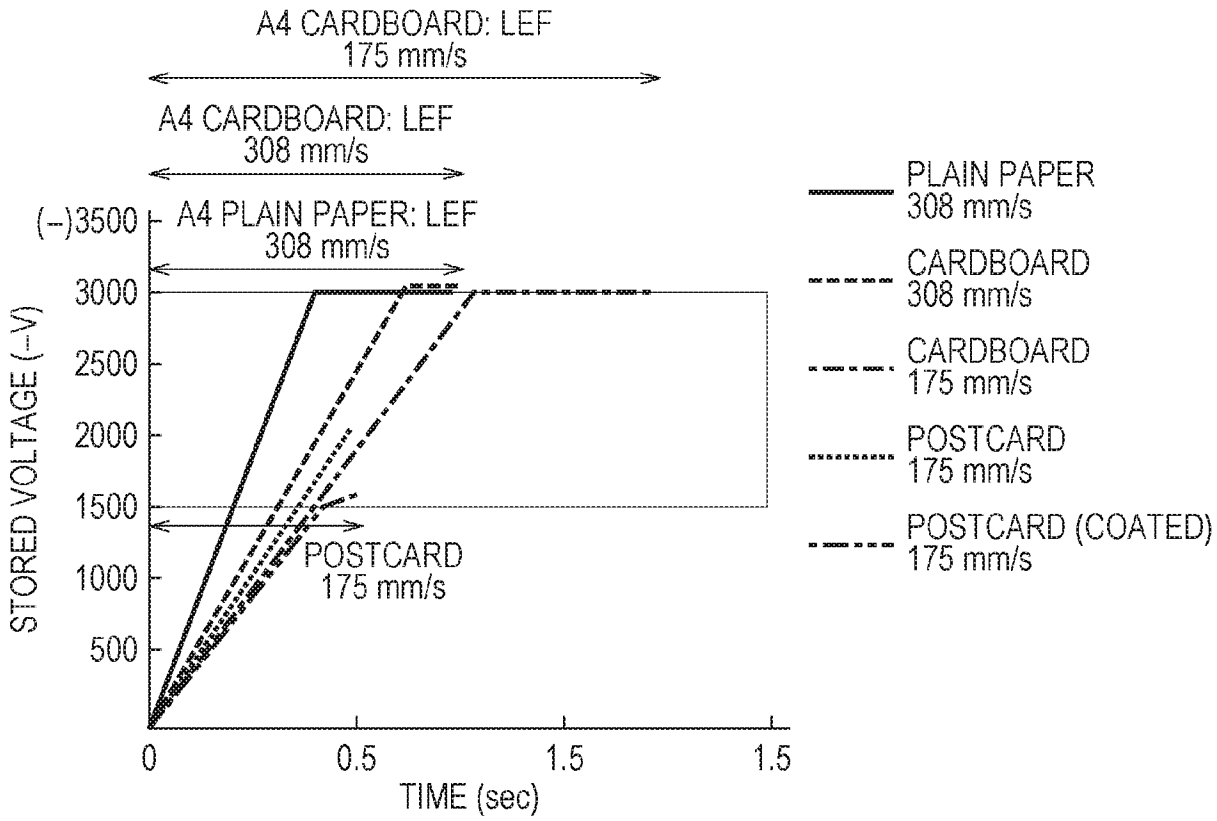
FIG. 4 illustrates the relationship between the length of a sheet and a stored voltage in a capacitor.
Figure 5:
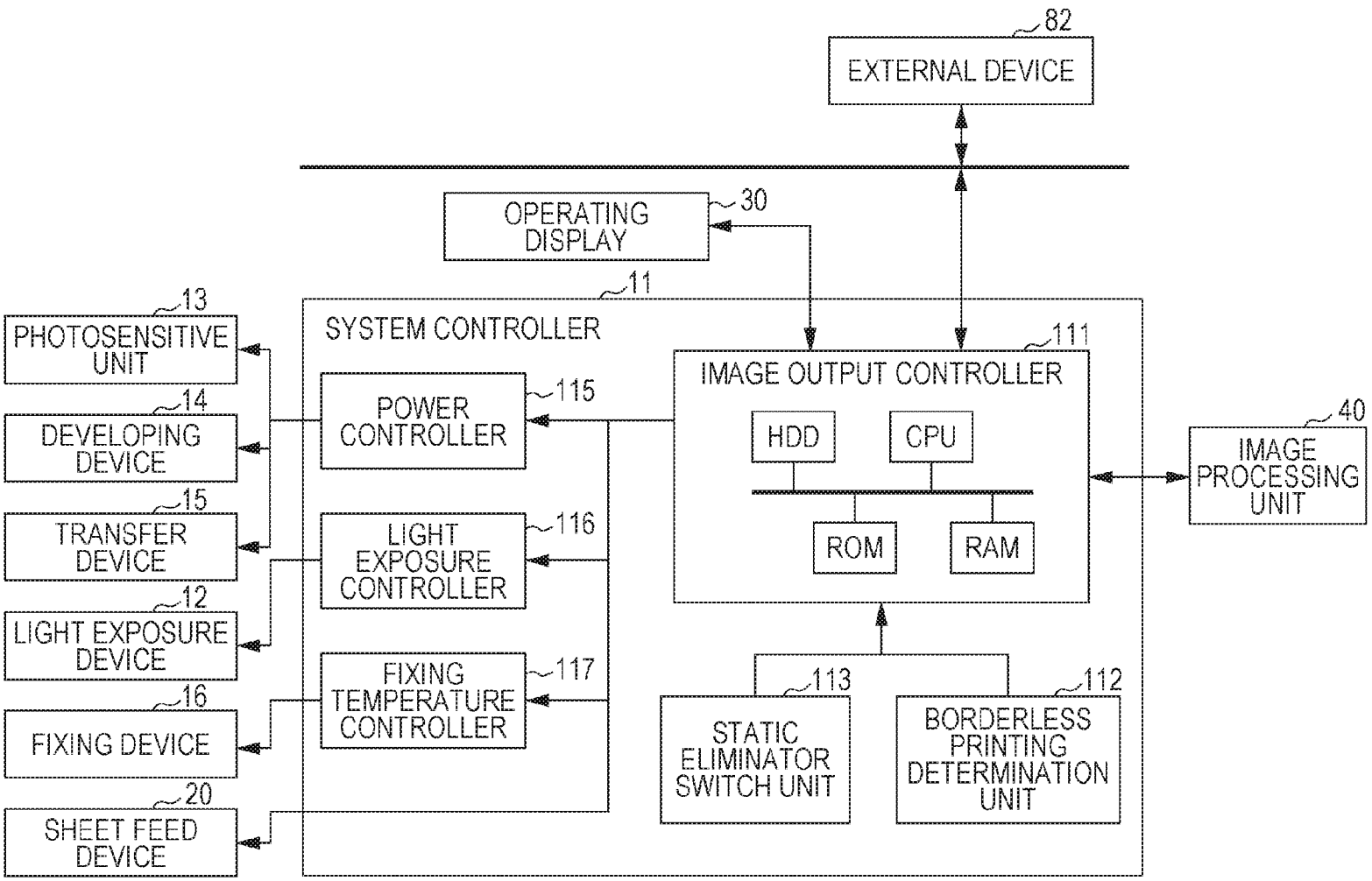
FIG. 5 is a block diagram illustrating an example of a functional configuration of the image forming apparatus.
Figure 6A:
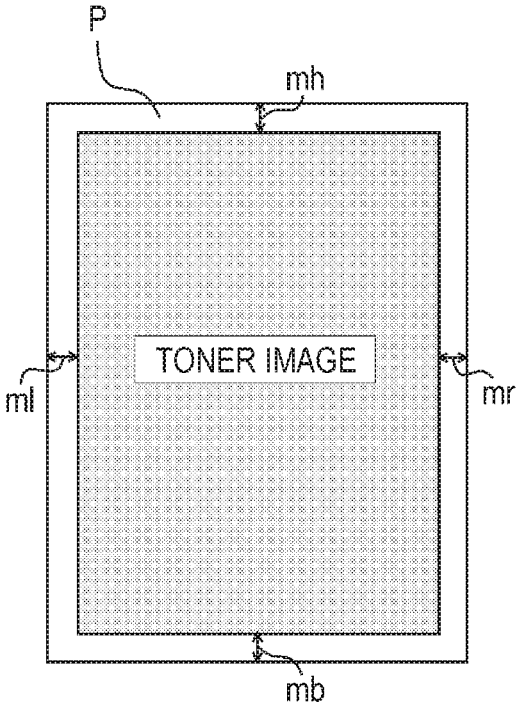
FIG. 6A illustrates bordered printing.
Figure 6B:
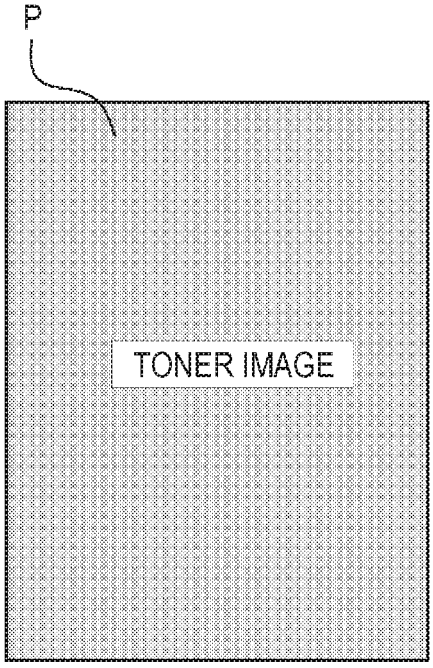
FIG. 6B illustrates borderless printing.
Figure 7A:
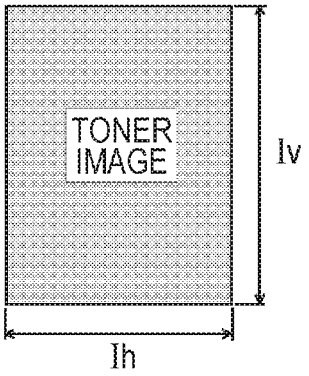
FIGS. 7A to 7C illustrate toner image formation in borderless printing.
Figure 7B:
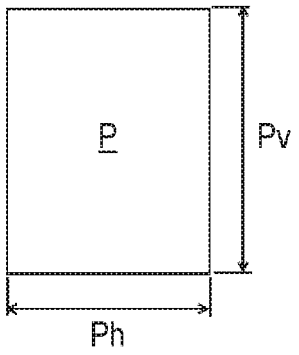
Figure 7C:
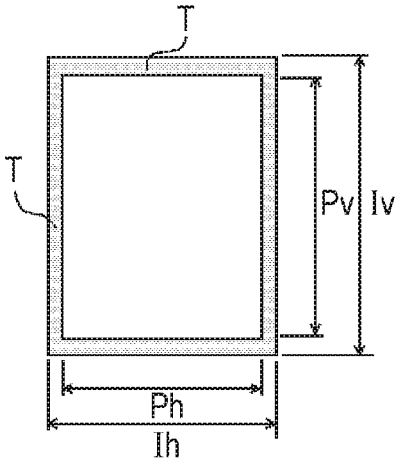

FIG. 2 is a schematic sectional view of the sheet transport device 16 having the second transfer portion TR. FIGS. 3A and 3B illustrate a configuration of the second transfer portion TR and a region around the second transfer portion TR and application of a bias for second transfer. FIG. 4 illustrates the relationship between the length of the sheet and a stored voltage in a capacitor C. FIG. 5 is a block diagram illustrating an example of a functional configuration of the image forming apparatus 1. FIG. 6A illustrates bordered printing, and FIG. 6B illustrates borderless printing. FIGS. 7A to 7C illustrate toner image formation in borderless printing.

(2.1) A Configuration of the Sheet Transport Device

The sheet transport device 16 includes the driven roller 24*b* of the registration roller pair 24, a sheet guide 161, the second transfer roller 162, a cleaning blade 163, a collection container 164, a static eliminator 165, and the transport guide 166.

The second transfer roller 162 is pressed against a backup roller 154 with the intermediate transfer belt 151 interposed therebetween so as to form the second transfer portion TR.

The intermediate transfer belt 151 is formed of a resin material such as polyimide or polyamide containing an appropriate amount of conductive agent such as carbon black. The intermediate transfer belt 151 is a film-shaped endless belt the volume resistivity of which is $10^6$ to $10^{14}$ Ω·cm and the thickness of which is, for example, about 0.1 mm.

The following rollers are provided along the intermediate transfer belt 151: the backup roller 154 that also serves as a drive roller that rotates the intermediate transfer belt 151; a driven roller 153 (see FIG. 1) that substantially linearly extends in a direction in which each of the photosensitive drums 131 is disposed and supports the intermediate transfer belt 151; a tension roller 155 (not illustrated) that applies a certain amount of tension to the intermediate transfer belt 151 and prevents the intermediate transfer belt 151 from walking; and a support roller 156 that is provided upstream of the second transfer portion TR and supports the intermediate transfer belt 151.

The backup roller 154 is a tube formed of blend rubber of ethylene propylene terpolymer (EPDM) and nitrile-butadiene rubber (NBR). Carbon is dispersed on the surface of the backup roller 154. The inside of the backup roller 154 is formed of the EPDM rubber. The surface resistivity of the backup roller 154 is $10^7$ to $10^{10}$ Ω/square and the diameter of the backup roller 154 is 28 mm. The hardness of the backup roller 154 is set to, for example, 70 degrees (Asker C hardness).

The backup roller 154 is disposed on the back side of the intermediate transfer belt 151 and serves as a counter electrode of the second transfer roller 162. The backup roller 154 is in contact with a metal power supply roller 154A that applies a bias voltage for forming a second transfer electric field in the second transfer portion TR.

The second transfer roller 162 is formed of, for example, semiconductive rubber having a volume resistivity of $10^6$ to $10^{10}$ Ω·cm. The second transfer roller 162 has a surface layer formed of a urethane rubber tube that is coated with fluorine. The diameter of the second transfer roller 162 is 28 mm and the hardness of the second transfer roller 162 is set to 30 degrees (Asker C hardness).

The second transfer roller 162 faces the backup roller 154 with the intermediate transfer belt 151 interposed therebetween and forms, together with the backup roller 154, the second transfer portion TR that transfers through second transfer the toner image held by the intermediate transfer belt 151 onto the sheet P transported from the sheet feed device 20.

A cleaner 167 that removes matter adhering to the surface of the second transfer roller 162 such as residual toner and paper dust faces the second transfer roller 162.

The cleaner 167 includes the cleaning blade 163 and the collection container 164. The cleaning blade 163 removes matter adhering to the surface of the second transfer roller 162 such as residual toner and paper dust. The collection container 164 contains the removed toner.

The static eliminator 165 that includes an electrode member 165*a* serving as an example of a pointed electrode and a guide 165*b* is disposed downstream of the second transfer portion TR in the sheet transport direction. The sheet P onto which the toner image has been transferred through second transfer is removed and separated from the intermediate transfer belt 151 while undergoing static electricity elimination from the back side of the sheet P by the electrode member 165*a*, and transported to the fixing device 17 through the transport guide 166 while being guided through the guide 165*b*.

(2.2) Control of Application of a Bias in Second Transfer

As illustrated in FIG. 3A, a power source unit 100 is connected to the power supply roller 154A that applies a transfer bias to the backup roller 154.

The power source unit 100 includes a transfer bias power source 101, a cleaning bias power source 102, and a switch 103. The transfer bias power source 101 supplies between the second transfer roller 162 and the backup roller 154 a transfer current that transfers the toner image onto the sheet P. The cleaning bias power source 102 supplies a cleaning bias voltage that prevents undesired toner such as a toner band which is a toner image formed on the intermediate transfer belt 151 and not intended to be transferred onto the sheet P from migrating to the second transfer roller 162.

In order to transfer through second transfer the toner image held on the intermediate transfer belt 151 onto the sheet P transported through the registration roller pair 24, the transfer bias power source 101 and the power supply roller 154A are connected to each other through the switch 103, so that a transfer bias the polarity of which is the same as the polarity of the toner (negative polarity according to the present exemplary embodiment) is applied to the backup roller 154. As a result, the toner on the intermediate transfer belt 151 is transferred onto the sheet P, and the back side of the sheet P is charged to the negative polarity.

A resistor-capacitor (RC) parallel circuit 120 in which a resistor R and a capacitor C are connected in parallel and which is connected to the electrode member 165*a* of the static eliminator 165. The RC parallel circuit 120 also includes a switch 121 that opens and closes connection between the electrode member 165*a* and the capacitor C.

As illustrated in FIG. 3B, regarding the static eliminator 165, when the switch 121 is closed while the sheet P is passing through a recording medium transfer region (a region from a nip between the intermediate transfer belt 151 and the second transfer roller 162 to the electrode member 165*a*), electric charge is stored in the capacitor C by the charged back side of the sheet P.

FIG. 4 illustrates examples of the stored voltage stored in the capacitor C with various sizes and types of the sheet P at different process speeds of the image forming apparatus 1. As illustrated in FIG. 4, with respect to the size of the sheet P, when the capacitor C having the capacitance of 100 nF is used, about −1500 V is stored with a postcard having a smallest sheet length, and about −3000V with an A4 sheet.

Furthermore, while the sheet P is passing through the recording medium transfer region, a negative electric field is generated between the sheet P and the electrode member 165*a* through the resistor R.

Specifically, when the resistor R having a resistance of 200 to 500 MΩ is used for the RC parallel circuit 120, a negative electric field of about −300 V is generated between the back side of the sheet P and the electrode member 165*a*.

(2.3) A Functional Configuration of a System Controller

The image forming apparatus 1 includes the system controller 11 that includes an image output controller 111, a borderless printing determination unit 112, a static eliminator switch unit 113, a power controller 115, a light exposure controller 116, and a fixing temperature controller 117, thereby controlling operation of the entire image forming apparatus 1 by executing a control program stored in memory.

The image output controller 111 controls exchanging of information with the sheet feed device 20. In addition, the image output controller 111 issues operating control instructions to the following components included in the image forming section 10: that is, the light exposure devices 12, the photosensitive units 13, the developing devices 14, the transfer device 15, the fixing device 17, and so forth.

Furthermore, the image output controller 111 issues operating control instructions to the following controllers included in the system controller 11: that is, the power controller 115, the light exposure controller 116, and the fixing temperature controller 117. That is, the image output controller 111 determines whether or not to supply power to and whether or not to drive the components included in the image forming section 10, that is, the light exposure devices 12, the photosensitive units 13, the developing devices 14, the transfer device 15, the sheet transport device 16, the fixing device 17, and so forth and issues the results of the determination to the controllers of these components.

Furthermore, the image output controller 111 exchanges information with the borderless printing determination unit 112 and the static eliminator switch unit 113 so as to perform predetermined operating control when the borderless printing is determined.

The borderless printing determination unit 112 determines whether the bordered printing is to be performed or the borderless printing is to be performed by detecting the presence or absence of peripheral margins in the sheet P for received image data.

As schematically illustrated in FIG. 6A, in the bordered printing, a toner image entirely fits in the sheet P with a top margin (mh), a bottom margin (mb), a left margin (ml), and a right margin (mr) set as peripheral margins along the edges of the sheet P.

In contrast, in the borderless printing, as illustrated in FIG. 6B, the toner image extends to end portions of the sheet P, and accordingly, none of the peripheral margins are set. Referring to FIG. 7B, there is no top margin, bottom margin, left margin, or right margin. However, when at least one of the end portions does not have its margin, it is determined to be the borderless printing.

(2.2) Borderless Printing

The image forming apparatus 1 has a bordered printing mode and a borderless printing mode. In the bordered printing mode, the image is printed on the sheet P with the margins set along the end portions at the entire periphery of the sheet P. In the borderless printing mode, the image printed on the sheet P extends to the end portions of the sheet P without the margins.

Whether or not this borderless printing is to be performed is determined by the borderless printing determination unit 112 of the system controller 11 that controls the operation of the image forming apparatus 1.

FIG. 7A illustrates the size of the toner image formed on the intermediate transfer belt 151. In FIG. 7A, Iv represents the vertical size and Ih represents the horizontal size. FIG. 7B illustrates the size of the sheet P. In FIG. 7B, Pv represents the vertical size and Ph represents the horizontal size.

As schematically illustrated in FIG. 7C, the relationships of the sizes of the toner image and the sheet P are set so that Pv<Iv and Ph<Ih. That is, the size of the toner image is slightly larger than the size of the selected sheet P so that the margins are not set in the sheet P even when the sheet P is fed with the position thereof slightly deviated vertically and horizontally.

The toner image having a size of Iv×Ih indicated by a shaded region is formed on the intermediate transfer belt 151. The toner image having a size of Iv×Ih is transported by the intermediate transfer belt 151 toward the second transfer portion TR. Meanwhile, timing control of the sheet P is performed by the registration roller pair 24 so that the sheet P is transported to the second transfer portion TR at timing adjusted to timing at which the toner image enters the second transfer portion TR. Thus, a borderless toner image without the margins at the periphery is formed on the sheet P.

The sheet P on which the borderless toner image without the margins has been formed is fixed onto the sheet P by heat and pressure in the fixing nip NF of the fixing device 17. The sheet P onto which the toner image has been fixed is separated from the heating module 171 side at the exit of the fixing nip NF and output to the sheet output tray TR1 in the upper surface of the image forming apparatus 1 through the first output roller pair 173.

Figure 11:
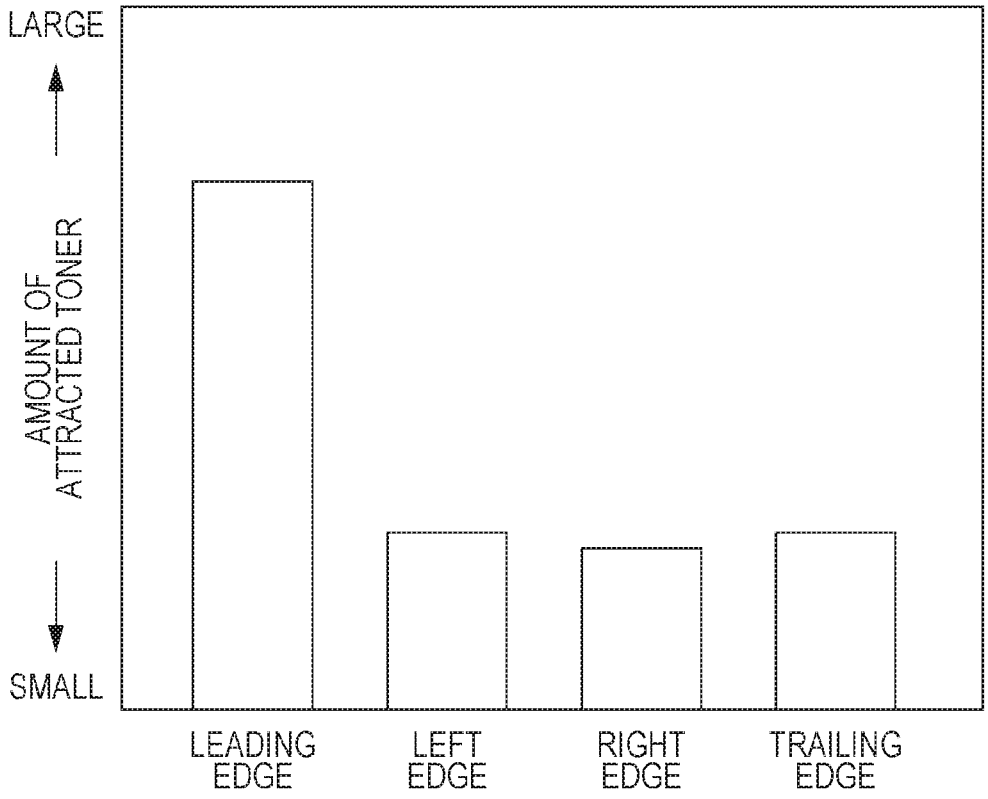
FIG. 11 illustrates the amount of toner attracted to four edges of the sheet when borderless printing is performed.

FIG. 11 illustrates the amount of toner attracted to four edges of the sheet P when borderless printing is performed. The size of the toner image is larger than the size of the sheet P in the borderless printing. Accordingly, parts of the toner image outside the sheet P are transferred to the second transfer roller 162, scraped off by the cleaning blade 163, and contained in the collection container 164.

In contrast, parts of the toner image outside the sheet P and not transferred to the second transfer roller 162 are attracted to the edges of the sheet P. The amount of toner attracted to the edges of the sheet P is, as illustrated in FIG. 11, largest at the leading edge and small at the other edges. The reason for this is thought to be that, when the sheet P enters the second transfer portion TR by being guided through the sheet guide 161, the leading edge of the sheet P is brought into contact with the intermediate transfer belt 151 that holds the borderless toner image.

The toner attracted to the edges of the sheet P may migrate to and accumulate on a region in or around the guide 165*b* of the static eliminator 165, thereby smearing the back side of the sheet P passing through the recording medium transfer region.

Figure 12A:
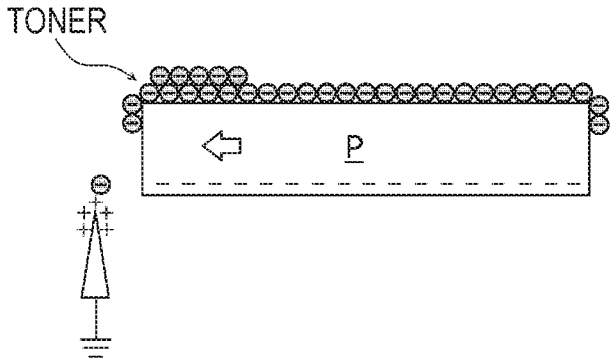
FIGS. 12A to 12C illustrate a structural example of the static eliminator of a comparative example that suppresses migration of the toner attracted to the edges of the sheet to the region in or around the guide.
Figure 12B:
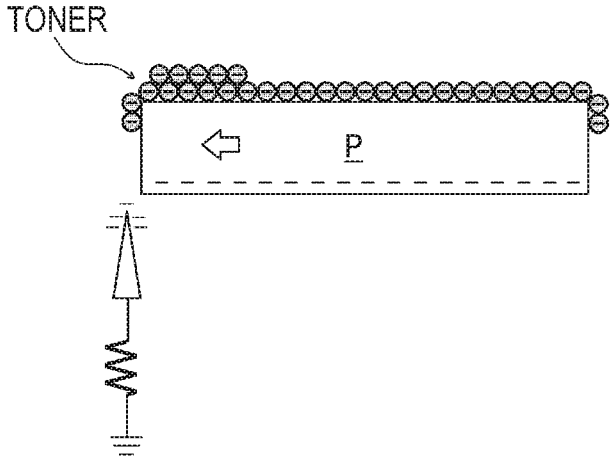
Figure 12C:
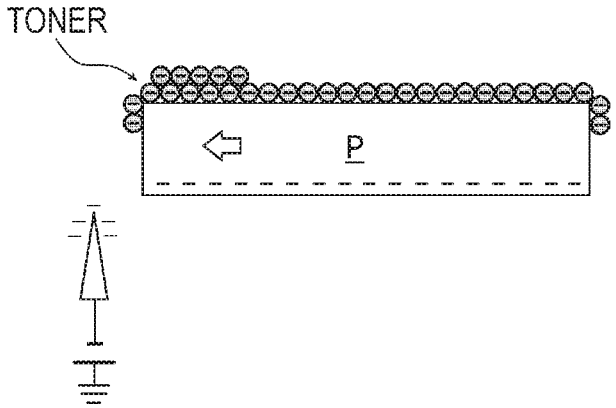

FIGS. 12A to 12C illustrate a structural example of the static eliminator of a comparative example that suppresses migration of the toner attracted to the edges of the sheet P to the region in or around the guide 165*b*. As illustrated in FIG. 12A, when the electrode member 165*a* is grounded, the electrode member 165*a* is charged to the positive polarity (+), and accordingly, the toner attracted to the leading edge electrostatically migrates to the electrode member 165*a*.

Furthermore, as illustrated in FIG. 12B, when the electrode member 165*a* is resistance grounded, the electrode member 165*a* is charged to the negative polarity (−) due to the passage of the sheet P. However, the migration to the electrode member 165*a* of the toner attracted to the leading edge of the sheet P that passes through the recording medium transfer region is not able to be prevented because a certain time period is required to generate a specified electric field.

FIG. 12C illustrates a configuration in which a power source is connected to the electrode member 165*a* to generate a negative-polarity electric field. This configuration prevents the migration to the electrode member 165*a* of the toner attracted to the leading edge and the other edges of the sheet P passing through the recording medium transfer region. However, this configuration needs a new power source. This increases the space and cost.

(3) Operation during Borderless Printing

Figure 8:
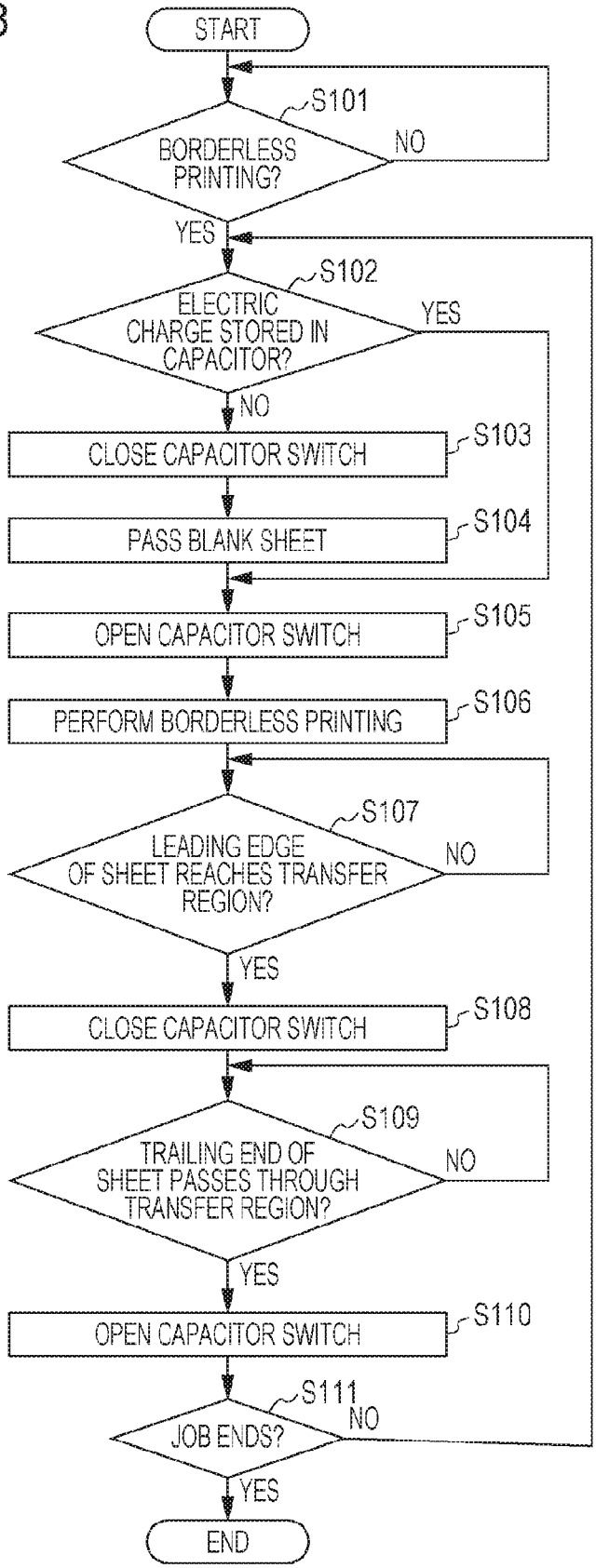
FIG. 8 is a flowchart illustrating a procedure of an operation during borderless printing.

FIG. 8 is a flowchart illustrating a procedure of an operation during borderless printing. FIGS. 9A to 9D are schematic views illustrating storing and releasing of electric charge in the static eliminator 165 during borderless printing. FIGS. 10A and 10B illustrate a configuration of the second transfer portion TR and a region around the second transfer portion TR and application of a bias for second transfer according to a variation. Operating control during the borderless printing is described below with reference to the drawings.

When an accepted print job is determined to be performed in the borderless printing mode, the image forming apparatus 1 according to the present exemplary embodiment causes electric charge to be stored in the capacitor C of the static eliminator 165. Then, when the leading edge of the sheet P onto which a borderless toner image has been transferred faces the electrode member 165*a*, the image forming apparatus 1 closes the switch 121 so as to release the electric charge through the electrode member 165*a*. Thus, the toner attracted to the leading edge of the sheet P may be prevented from migrating to a region in or around the electrode member 165*a* or the guide 165*b*.

Upon receipt of a print job, the system controller 11 determines whether the print job accepted by the borderless printing determination unit 112 is to be performed in the bordered printing mode or the borderless printing mode (S101). Specifically, whether or not there are peripheral margins, that is, the top margin (mh), the bottom margin (mb), the left margin (ml), and the right margin (mr) at the periphery of the sheet P is detected. If at least one end portion does not have the margin, it is determined that the borderless printing is to be performed.

If it is determined that the print job is to be performed in the borderless printing mode in step S101, it is determined whether or not electric charge is stored in the capacitor C connected to the electrode member 165*a* (S102). If the electric charge is not stored in the capacitor C ("NO" in S102), the switch 121 is closed through the static eliminator switch unit 113 (S103).

If it is determined that the electric charge is not stored in the capacitor C in step S102 ("NO" in S102), a blank sheet without a toner image is caused to pass (S104). At this time, the transfer bias power source 101 and the power supply roller 154A are connected to each other, so that a negative-polarity transfer bias is applied to the backup roller 154. This causes the electric charge to be stored in the capacitor C so that the storage voltage is about −3000 V at the maximum.

Then, the switch 121 is opened (S105), and the borderless printing is performed (S106). When the borderless printing is performed and the toner image is transferred through second transfer to the sheet P, the sheet P is transported to the static eliminator 165 with the toner attracted to the edges of the sheet P (see FIG. 9A).

Then, at timing at which the leading edge of the sheet P reaches the transfer region ("YES" in S107), the switch 121 is closed (S108). The timing at which the leading edge of the sheet P reaches the transfer region is determined in accordance with a predetermined time period from timing of the start of rotation of the registration roller pair 24 based on the process speed. When the switch 121 is closed, the capacitor C that stores the electric charge releases the electric charge through the electrode member 165*a* toward the leading edge of the sheet P. Thus, the toner attracted to the leading edge of the sheet P may be prevented from migrating to the region in or around the electrode member 165*a* or the guide 165*b* (see FIG. 9B).

When the sheet P is transported toward the fixing device 17 along the transport guide 166 with the switch 121 closed, the toner attracted to three edges of the sheet P other than the leading edge may be prevented from migrating to the region in or around the electrode member 165*a* or the guide 165*b* by the negative-polarity electric field (about −300 V) generated by the resistor R.

Figure 9A:
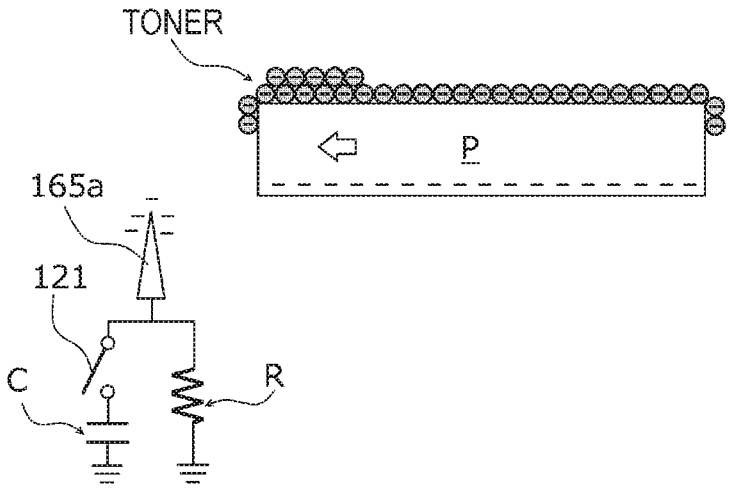
FIGS. 9A to 9D are schematic views illustrating storing and releasing of electric charge in a static eliminator during borderless printing.
Figure 9B:
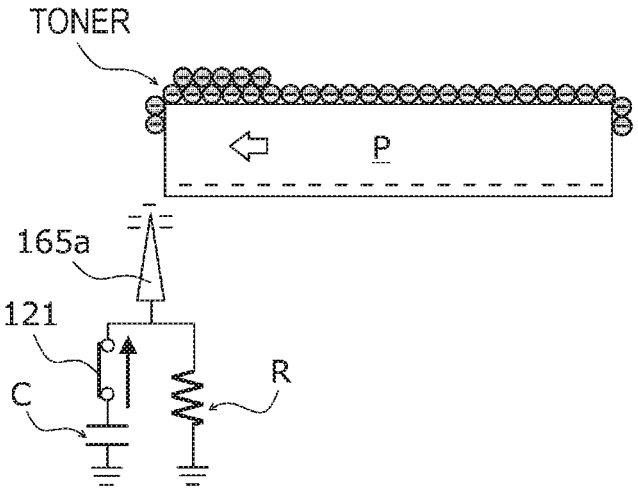
Figure 9C:
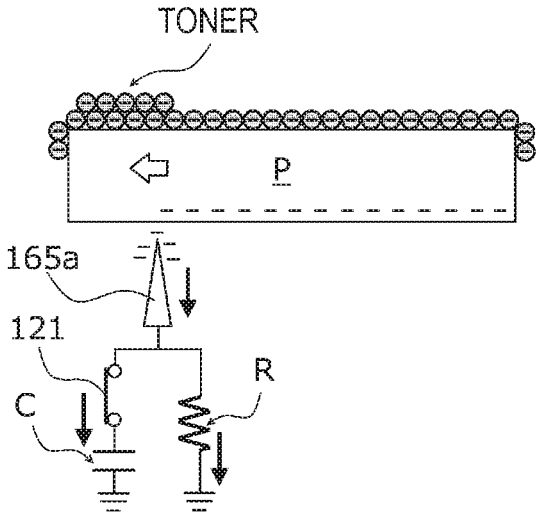
Figure 9D:
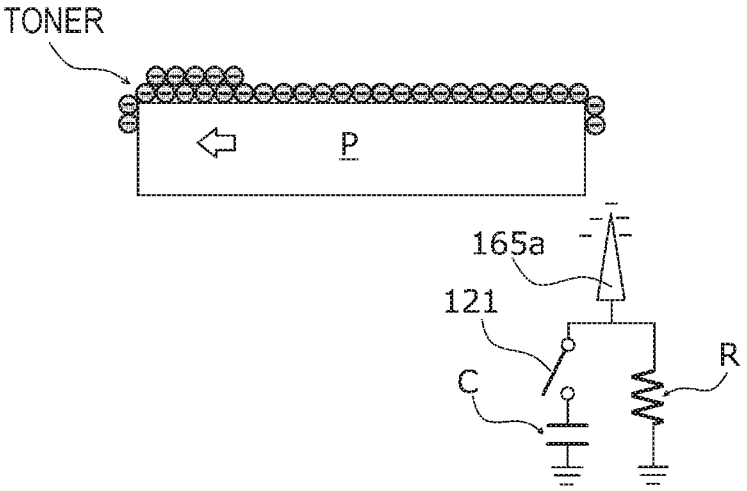
Figure 10A:
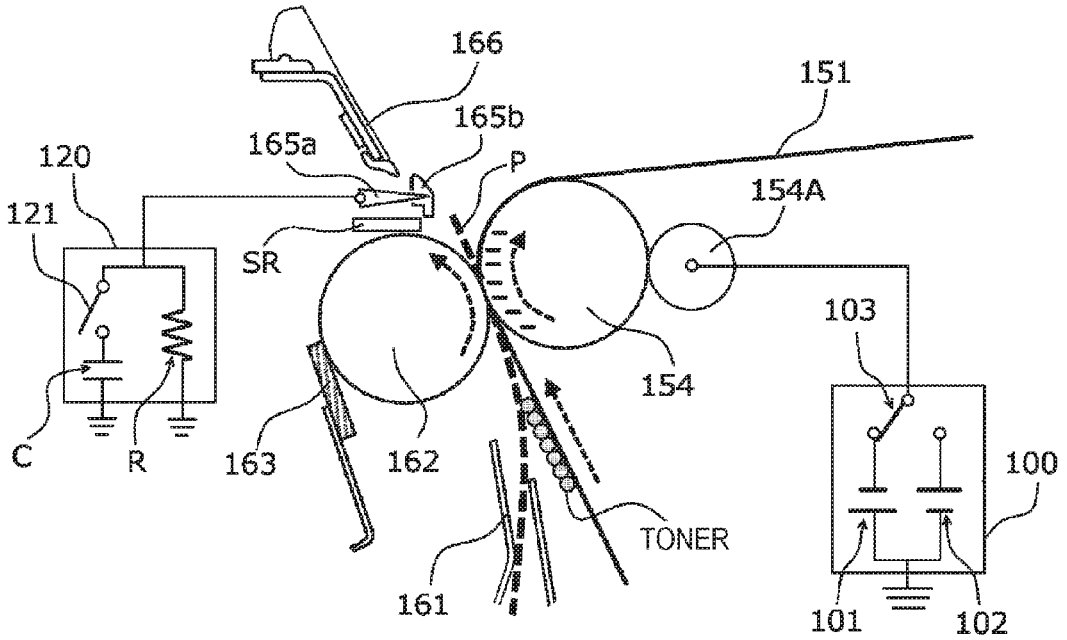
FIGS. 10A and 10B illustrate a configuration of a second transfer portion and a region around the second transfer portion and application of a bias for second transfer according to a variation.
Figure 10B:
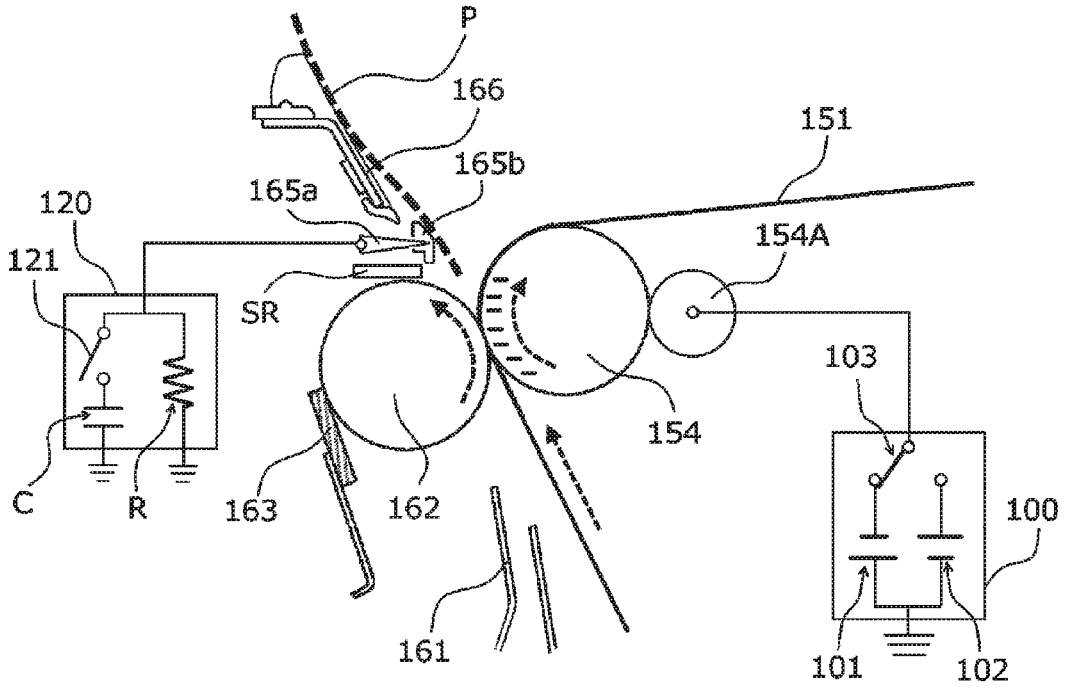

At the same time, electric charge is stored again in the capacitor C through the electrode member 165*a* due to passage of the charged back side of the sheet P (see FIG. 9C).

Then, at timing at which the trailing edge of the sheet P passes through the recording medium transfer region ("YES" in S109), the switch 121 is opened (S110). The timing at which the trailing edge of the sheet P passes through the recording medium transfer region is determined in accordance with a predetermined time period from timing of entrance of the sheet P into the recording medium transfer region based on the sheet length of the sheet P and the process speed.

Then, if the print job ends ("YES" in S111), electric charge is stored in the capacitor C of the static eliminator 165 so that the storage voltage becomes about −1500 to −3000 V corresponding to the sheet length of the sheet P. With the electric charge stored in the capacitor C, the toner attracted to the leading edge of the sheet P due to releasing of the electric charge through the electrode member 165*a* may be prevented from migrating to the region in or around the electrode member 165*a* or the guide 165*b* in the next borderless printing.

A Variation

FIGS. 10A and 10B illustrate a configuration of the second transfer portion TR and a region around the second transfer portion TR and application of a bias for second transfer in the image forming apparatus 1 according to a variation.

The sheet transport device 16 includes a detection sensor SR serving as a detector that detects at a position downstream of the second transfer roller 162 in the sheet transport direction the leading edge and the trailing edge of the sheet P transported to the upstream side relative to the static eliminator 165 in the sheet transport direction. A reflection-type optical sensor that includes a light receiving element and a light emitting element that includes a light emitting diode (LED) or the like is used as the detection sensor SR.

The image forming apparatus 1 according to the variation closes the switch 121 after a predetermined time period required for the sheet P to reach a position where the sheet P faces the electrode member 165*a* has passed from timing at which the leading edge of the sheet P is detected by the detection sensor SR.

Thus, electric charge stored in the capacitor C is released through the electrode member 165*a* toward the leading edge of the sheet P. This may prevent the toner attracted to the leading edge of the sheet P from migrating to the region in or around the electrode member 165*a* or the guide 165*b*.

Then, the image forming apparatus 1 opens the switch 121 after a predetermined time period required for the trailing edge of the sheet P to reach a position where the trailing edge of the sheet P faces the electrode member 165*a* has passed from timing at which the trailing edge of the sheet P is detected by the detection sensor SR.

In this way, a state of the capacitor C in which the electric charge is stored therein through the electrode member 165*a* due to passage of the charged back side of the sheet P is maintained, and, in the next borderless printing, the electric charge is released through the electrode member 165*a*. Thus, the toner attracted to the leading edge of the sheet P may be prevented from migrating to the region in or around the electrode member 165*a* or the guide 165*b*.

As has been described, releasing electric charge from and storing the electric charge in the capacitor C may be reliably performed by directly detecting the leading edge and the trailing edge of the sheet P at a position immediately upstream of the static eliminator 165 in the sheet transport direction.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that transfers a toner image formed on an image holding body to a recording medium; and a static eliminating unit that is disposed downstream of the transfer unit in a transport direction in which the recording medium is transported, that stores electric charge while the recording medium is passing through a recording medium transfer region, and that releases the electric charge when a leading edge of the recording medium enters the recording medium transfer region.

2. The image forming apparatus according to claim 1, wherein the static eliminating unit includes a pointed electrode arranged to face the recording medium, a resistor-capacitor parallel circuit in which a resistor and a capacitor are connected in parallel and which is connected to the pointed electrode, and a switch that opens and closes connection through which the capacitor and the pointed electrode are connected to each other, and wherein, in a case where the toner image to be transferred to the recording medium is a borderless image, the switch is closed when the leading edge of the recording medium faces the pointed electrode, and the switch is opened when a trailing edge of the recording medium has passed a region facing the pointed electrode.

3. The image forming apparatus according to claim 2, wherein the electric charge is stored in the capacitor through the pointed electrode by causing the recording medium on which the toner image is not formed to pass through the recording medium transfer region before the toner image is transferred to the recording medium.

4. The image forming apparatus according to claim 2, wherein the capacitor releases the electric charge when the leading edge of the recording medium faces the pointed electrode, and the capacitor stores the electric charge again through the pointed electrode while the recording medium is passing through the recording medium transfer region.

5. The image forming apparatus according to claim 3, wherein, in the transport direction, a length of the recording medium is equal to a length of a postcard size or larger.

6. The image forming apparatus according to claim 4, wherein, in the transport direction, a length of the recording medium is equal to a length of a postcard size or larger.

7. The image forming apparatus according to claim 3, wherein a polarity of the electric charge stored in the capacitor is identical to a polarity of toner with which the toner image is formed.

8. The image forming apparatus according to claim 4, wherein a polarity of the electric charge stored in the capacitor is identical to a polarity of toner with which the toner image is formed.

9. The image forming apparatus according to claim 5, wherein a polarity of the electric charge stored in the capacitor is identical to a polarity of toner with which the toner image is formed.

10. The image forming apparatus according to claim 6, wherein a polarity of the electric charge stored in the capacitor is identical to a polarity of toner with which the toner image is formed.

11. The image forming apparatus according to claim 1, further comprising:

a detector that detects at a position downstream of the transfer unit in the transport direction the leading edge and a trailing edge of the recording medium transported to an upstream side relative to the static eliminating unit in the transport direction, wherein the static eliminating unit includes a pointed electrode arranged to face the recording medium, a resistor-capacitor parallel circuit in which a resistor and a capacitor are connected in parallel and which is connected to the pointed electrode, and a switch that opens and closes connection through which the capacitor and the pointed electrode are connected to each other, and wherein the switch is closed when the detector detects the leading edge of the recording medium, and the switch is opened when the detector detects the trailing edge of the recording medium.

12. The image forming apparatus according to claim 2, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

13. The image forming apparatus according to claim 3, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

14. The image forming apparatus according to claim 4, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

15. The image forming apparatus according to claim 5, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

16. The image forming apparatus according to claim 6, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

17. The image forming apparatus according to claim 7, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

18. The image forming apparatus according to claim 8, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

19. The image forming apparatus according to claim 9, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

20. The image forming apparatus according to claim 10, further comprising:

a detector that detects at a position downstream of the transfer unit in the transport direction the leading edge and the trailing edge of the recording medium transported to an upstream side relative to the static eliminating unit in the transport direction, wherein the switch is closed when the detector detects the leading edge of the recording medium, and the switch is opened when the detector detects the trailing edge of the recording medium.

* * * * *